United States Patent [19]

Wallis

[11] Patent Number: 4,665,733

[45] Date of Patent: May 19, 1987

[54] DIE CLAMP

[76] Inventor: Bernard J. Wallis, 25315 Kean Ave., Dearborn, Mich. 48124

[21] Appl. No.: 756,178

[22] Filed: Jul. 18, 1985

[51] Int. Cl.[4] ..... B25B 1/08; B21D 37/08

[52] U.S. Cl. ..... 72/481; 269/91; 269/94; 269/135; 269/229; 269/235

[58] Field of Search ..... 72/481, 448, 462; 269/32, 91, 93, 94, 135, 155, 200, 229, 235

[56] References Cited

U.S. PATENT DOCUMENTS

| | | | |
|---|---|---|---|
| 2,908,205 | 10/1959 | Furman et al. | 269/94 |
| 3,147,005 | 9/1964 | Miller | 269/91 |
| 3,302,943 | 2/1967 | Meride, Jr. | 269/94 |
| 3,311,367 | 3/1967 | Sendoykas | 269/91 |
| 3,724,837 | 4/1973 | McPherson | 269/135 |
| 4,274,332 | 6/1981 | Nakamura | 72/481 |
| 4,365,792 | 12/1982 | Johns | 269/93 |

FOREIGN PATENT DOCUMENTS

| | | | |
|---|---|---|---|
| 12538 | 10/1955 | Fed. Rep. of Germany | 269/94 |

*Primary Examiner*—Lowell A. Larson
*Assistant Examiner*—David B. Jones
*Attorney, Agent, or Firm*—Barnes, Kisselle, Raisch, Choate, Whittemore & Hulbert

[57] ABSTRACT

A die clamp arrangement for a press has a clamping lever that is shifted horizontally by a dog between an extended and a retracted position and rotated in a vertical plane between a clamping position and a released position. The cam and dog are interconnected for rotation in unison by a single shaft. In the retracted position the clamping lever is adapted to permit vertical movement of a die into and out of a press. Means are provided for actuating the clamps at the rear and at each side of the die from the front side of the press. The clamps at the front and/or the rear sides of the press are arranged to be pivoted from an operative position downwardly to an out-of the-way position below the top face of the press bolster.

8 Claims, 14 Drawing Figures

DIE CLAMP

This invention relates to a die clamp arrangement for stamping presses.

In a conventional stamping press arrangement upper and lower die sections are normally secured to adapter plates firmly attached to the ram and bolster of the press by means of a plurality of clamps located at the front, back and both sides of the dies. In some pressses dies are frequently replaced with others and it is therefore desirable to have all of the clamps readily acdessible from the front side of the press. In some press arrangements it is desirable to raise and lower the die vertically to remove it from and replace it in the press. In other situations it is necessary to slide the die horizontally into and out of the press. In still other press arrangements it is necessary to both shift the die vertically and horizontally in order to remove it from or replace in the press.

Conventional die clamps are normally bolted to the ram and bolster of the press and the free ends of their clamping levers usually project laterally inwardly in overhanding relation with the edges of the adapter plate on which the die section is mounted both when the clamps are in the clamped condition and when in the unclamped condition. Because the clamps are bolted to the press and their clamping levers overhang the adjacent edges of the adapter plates, regardless of whether a die section is shifted vertically or horizontally or both vertically and horizontally when removed from or replaced in the press, it usually becomes necessary to physically remove several clamps from the press along one or more sides of the die when the die is changed.

The present invention has for its primary object the provision of a die clamp which in the unclaimed position enables the die to be raised and lowered vertically into or out of position on a press bolster without removing the clamp.

Another object of the present invention is to provide a die clamp having a clamping lever which, when actuated, is designed to have two independent motions, a horizontal shifting motion and a vertical rocking motion about a horizontal axis.

A further object of the invention is to provide a die clamp incorporating a rotatable cam adapted when rotated to sequentially shift a clamp lever horizontally to and from an extended position and to rotate the clamp lever vertically about a horizontal axis.

Another object of the present invention is to provide a basic clamp structure designed to be placed at any side of the die and actuated from the front side of the press.

Still another object of the invention is to provide a clamp adapted to be mounted on a press in a hinged manner so that it can be pivoted to an out-of-the-way position to enable removal or replacement of the die without requiring removal of the clamp.

More specifically, the die clamp of the present invention includes a clamp housing on which is mounted a die clamping lever adapted to be shifted horizontally from a retracted position to an extended position. In the retracted position the free end of the clamp lever is located closely adjacent an end of the housing. In the extended position the free end of the clamp lever extends outwardly substantially beyond the end of the housing. In the extended position the lever is adapted to be rocked about a horizontal axis for clamping engagement with the adapter plate on which the die section is mounted. The clamp lever is adapted to be shifted horizontally and rocked vertically by mans of a rotatable cam and a dog operated by a single threaded nut. The clamps at the rear and sides of the die have rotatable shafts extending to the front side of the press which are connected by gears or the like with the rotatable nuts on the clamp housings for operating the clamp levers. The clamps at the front and/or the rear side of the die are pivotally mounted on brackets bolted to the bolster to enable those clamps to be swung downwardly out of the horizontal path of movement of a die being removed from or replaced in the press.

Other objects, features and advantages of the present invention will become apparent from the following description and accompanying drawings, in which.

Figure 1:
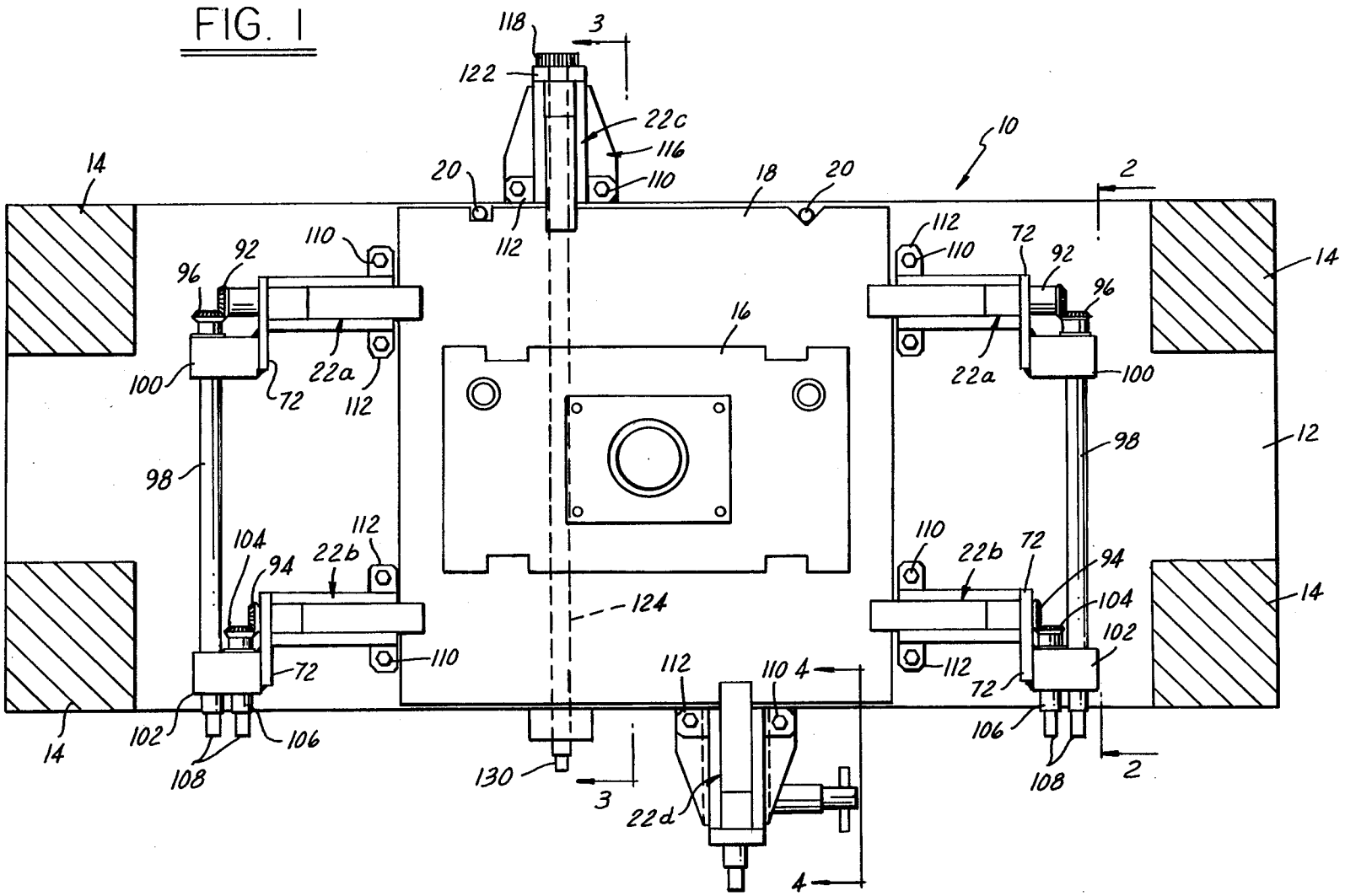
FIG. 1 is a plan view of a press bolster having a die fixedly secured thereto by means of six clamps arranged in accordance with the present invention.
Figure 2:
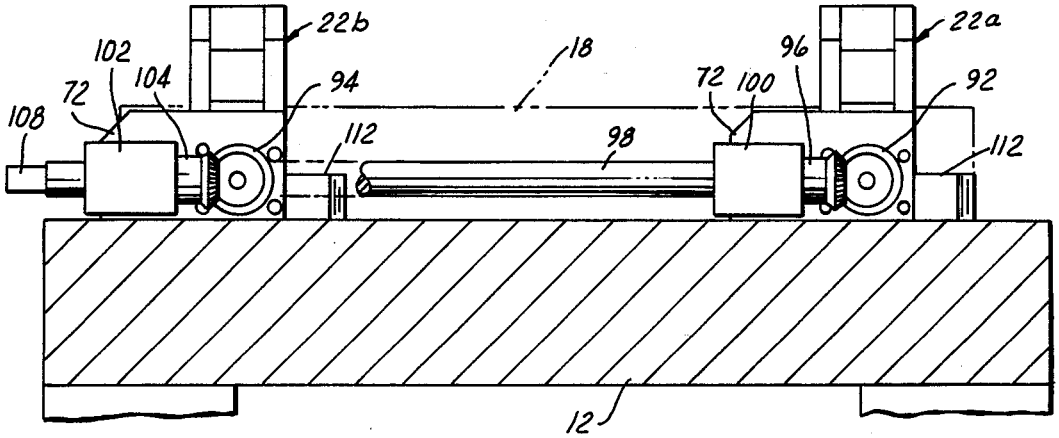
FIG. 2 is a sectional view along the line 2—2 in FIG. 1.

In FIG. 1 there is illustrated a stamping press 10, the bolster of which is designated 12. The ram of the press (not illustrated) is guided for vertical movement by means of a superstructure which includes four corner upright posts 14. A lower die section 16 is securely mounted by any suitable means to a die adapter plate 18 which is accurately located on bolster 12 by means of locating pins 20. In the arrangement illustrated adapter plate 18, and accordingly the die 16, is firmly clamped on bolster 12 by means of six clamps, two at each side of the die, one at the back and one at the front side of the press. The two clamps at each side of plate 18 are designated **22*a* and 22*b*, the clamp at the rear side 22*c*, and the clamp at the front side 22*d*. Each of the calmps 22** are of substantially identical construction and differ from one another only in a very minor respect.

Figure 5:
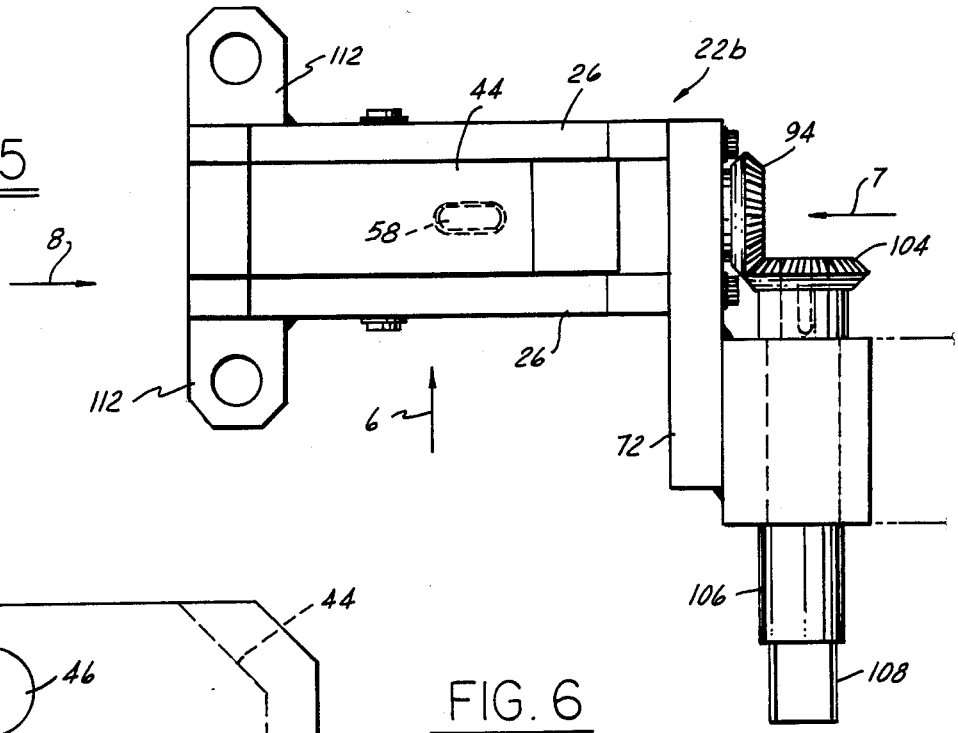
FIG. 5 is a top view of one of the clamps at one side of the die.
Figure 6:
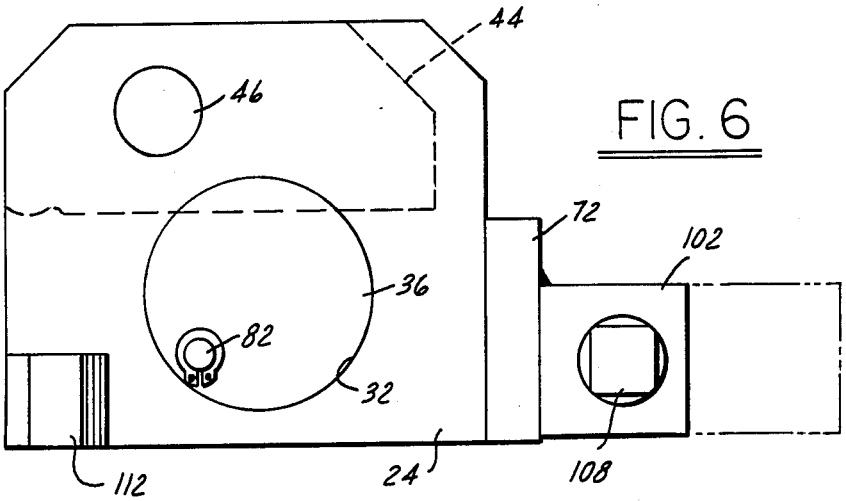
FIG. 6 is a view in the direction of the arrow 6 in FIG. 5.
Figure 8:
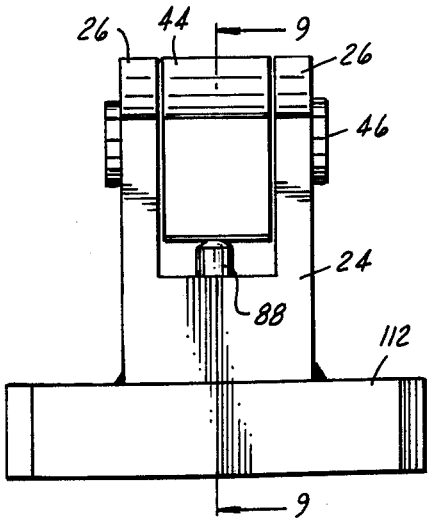
FIG. 8 is a view in the direction of the arrow 8 in FIG. 5.
Figure 9:
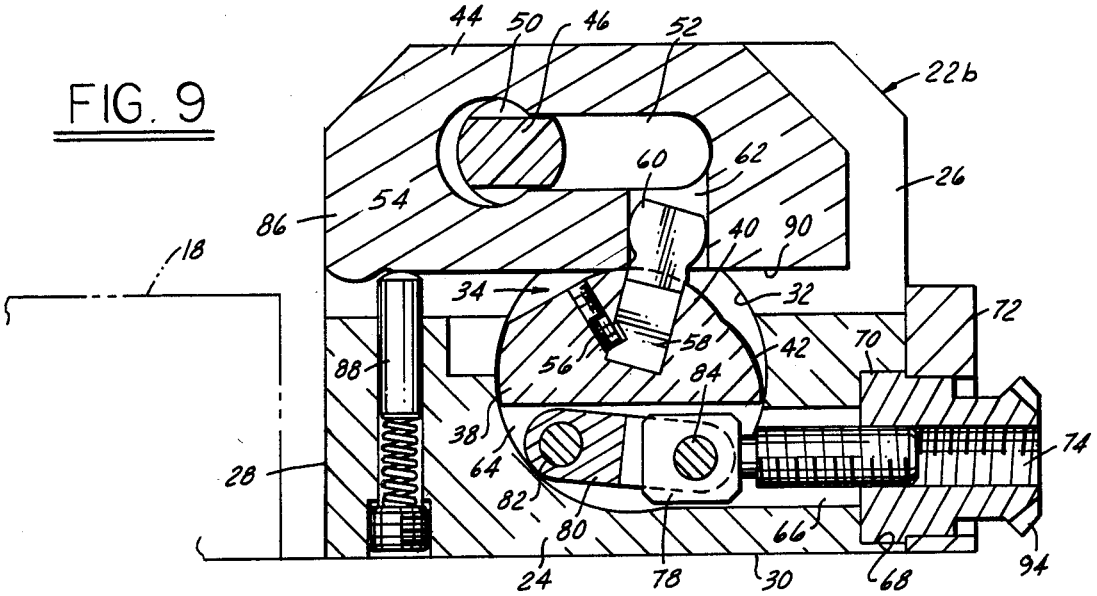
FIG. 9 is a sectional view along the line 9—9 in FIG. 8 and showing the clamp lever in the retracted position.

Referring to FIG. 9, each clamp 22 comprises a housing 24 having a pair of laterally spaced upright parallel flanges 26 (FIG. 5) extending lengthwise along the upper side of the housing. Each housing has a front face 28 and a bottom face 30 which forms the mounting face for the clamp. Each housing 24 has a large transverse through bore 32 in which is journalled a rotary cam member 34. Cam member 34 comprises a pair of laterally spaced discs 36 having a close rotary fit with the opposite ends of bore 32. Discs 36 are interconnected by a cam 38 therebetween having a surface 40 formed as a segment of a cylinder concentric with discs 32, but having a shorter radius. Cam 38 is also formed with a peripheral cam surface 42 eccentric to the axis of cam 38 and curving radially outwardly in a clockwise direction from the trailing end of the cylindrical surface 40.

Figure 12:
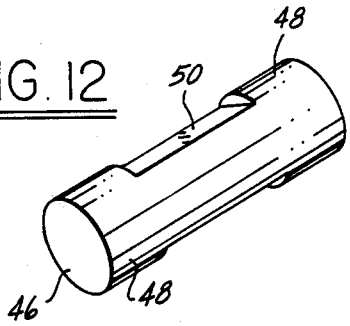
FIG. 12 is a perspective view of the guide pin for the clamping lever.
Figure 13:
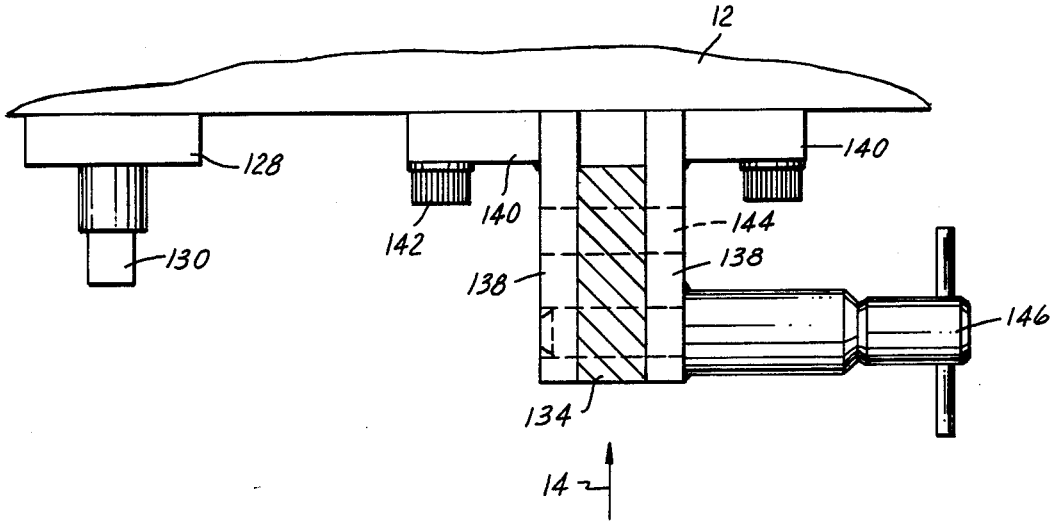
FIG. 13 is a sectional view along the line 13—13 in FIG. 4.

Within the slot defined by the laterally spaced flanges 26 there is arranged a clamp lever 44 guided for longitudinal and rocking movement between flanges 26 by a pin 46 (FIG. 12). Pin 46 has cylindrical opposite ends 48 and a pair of diametrically opposite flats 50 between its ends. Lever 44 has a longitudinally extending slot 52 dimensioned to have a sliding fit with the opposed flats 50 on pin 46. Adjacent its forward end slot 52 is formed with a circular opening 54 which accommodates the cylindrical ends 48 of pin 46. On cam 38 is mounted, as by a screw 56, a dog 58 which extends radially outwardly thereon through the cylindrical surface 40. The radially outer end of dog 58 is rounded as at 60 and is engaged with a sliding fit in a vertical slot 62 extending downwardly on clamping lever 44 from the rear end of slot 52.

The lower side of cam 38 is cut away between discs 36 as at 64. A generally rectangular bore 66 extends inwardly from the rear end of housing 24 and communicates with the cut-out section 64. Bore 66 has a circular counterbore 68 at the rear face of the housing 24. A circular nut 70 is clamped for rotation within counterbore 68 by a back plate 72 on the clamp housing. Nut 70 has a threaded bore 74 with which a threaded shaft 76 is engaged. The forward end of shaft 76 is formed as a clevis 78 of rectangular cross section designed to slide lengthwise within rectangular bore 66. A link 80 pivotally connected to the two discs 36 by a pin 82 connects with clevis 78 by means of a pin 84. With the above described arrangement it will be appreciated that upon rotation of nut 70 in opposite directions cam 34 will be rotated within the bore 32 in opposite directions. When nut 70 is rotated in the direction to rotate cam member 34 in a counterclockwise direction dog 58 will displace lever 44 in a direction to the left as viewed in FIG. 9. The front nose portion 86 of lever 44 is biased upwardly by a spring pressed plunger 88 thus causing the rear lower face portion 90 of lever 44 to bear downwardly on the upper peripheral surface of cam 38.

Figure 10:
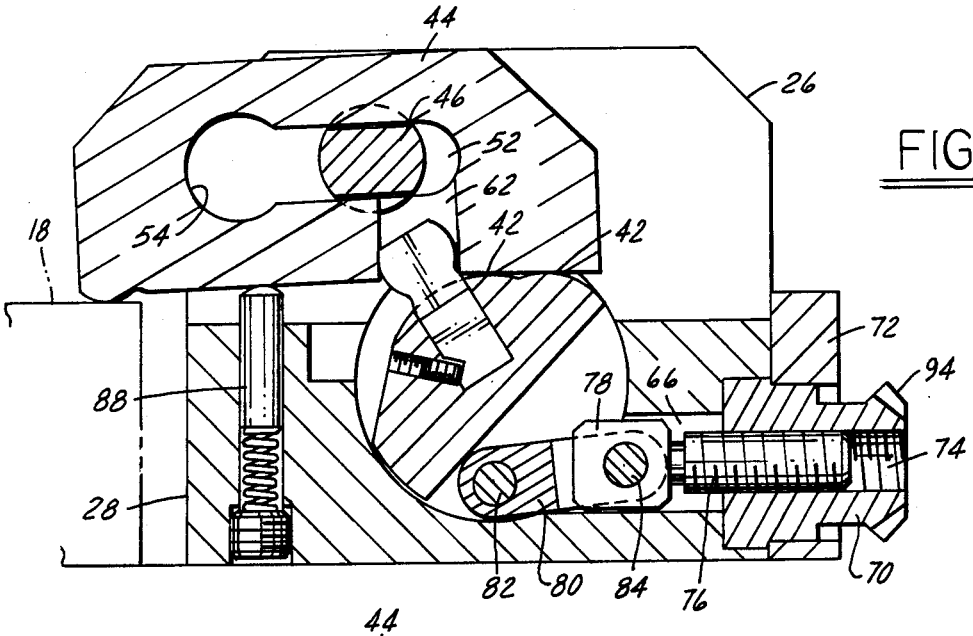
FIG. 10 is a view similar to FIG. 9 and showing the clamp lever in the extended clamping position.
Figure 11:
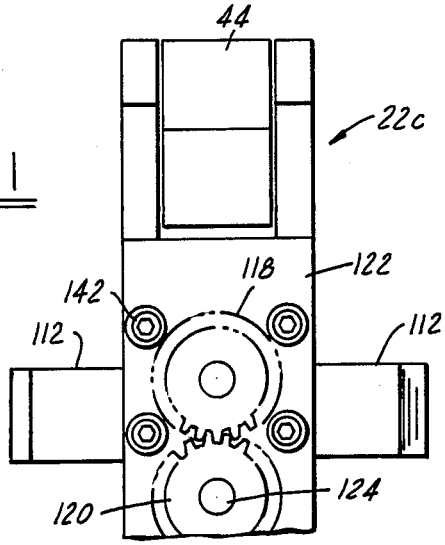
FIG. 11 is an end view of the clamp at the rear side of the press.

In the position of the components illustrated in FIG. 9 the surface 90 is bearing downwardly on the cylindrical surface 40 of cam 38. Thus, lever 44 is initially displaced in a generally straight line horizontally to the left from the retracted position wherein the nose portion 86 of the lever is generally flush with the front face 28 of the clamp housing 24. Eventually as the cam 34 continues to rotate in a counter-clockwise direction, the face 90 of lever 44 is engaged by the eccentric cam surface 42 which curves radially outwardly from the trailing end of cylindrical surface 40. Thus, as shown in FIG. 10, the interengagement of the bottom surface 90 of lever 44 with the eccentric cam surface 42 causes lever 44 to pivot in a counterclockwise direction on pin 46 so as to cause the nose portion 86 of the lever to clamp downwardly on the adapter plate 18. Thus it will be seen that by merely rotating nut 70 clamp lever 44 is shifted from the retracted position shown in FIG. 9 to the extended clamping position shown in FIG. 10.

Referring again to FIG. 1, it will be observed that in clamps *22a* the nut 70 comprises a bevel pinion gear 92 and on clamp *22b* the nut comprises a bevel pinion gear 94. These gears can be keyed to or formed integrally with the nuts 70. Each gear 92 meshes with a bevel pinion gear 96 keyed to the inner end of a shaft 98 extending to the front side of the press and journalled in brackets 100,102. In like manner, each bevel pinion 94 meshes with a similar bevel pinion gear 104 mounted on the inner end of a stub shaft 106 journalled in bracket 102. Shafts 98,106 have noncircular free ends 108 which enables them to be manually rotated by a suitable tool, such as a crank or a wrench to operate the clamps.

Figure 7:
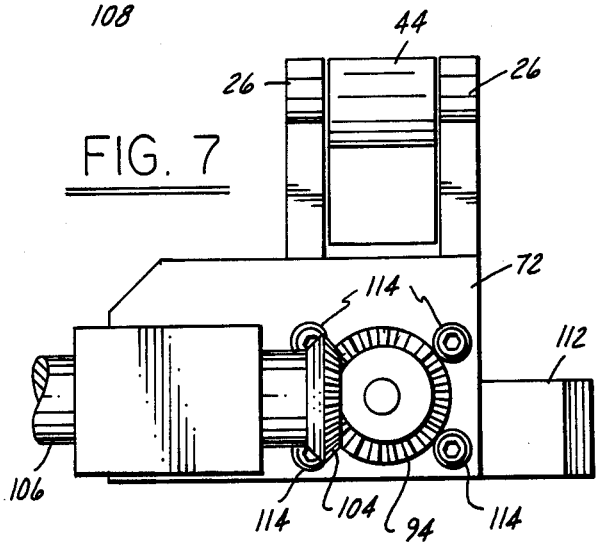
FIG. 7 is a view in the direction of the arrow 7 in FIG. 5.

Clamps *22a, 22b* are secured to the bolster 12 by means of screws 110 extending downwardly through ears 112 which are provided on each clamp housing adjacent the lower front end thereof. With respect to clamps *22a* and *22b* it will be observed that the clamps at each side of the die are identical except for the length of the shanks of the bevel pinion gears 92,94. With respect to the clamps *22a* and *22b* at opposite sides of the die, these clamps are identical except for the fact that the back plates 72 are one side are mounted in a reverse position with respect to the back plates 72 on the opposite side of the die. As shown in FIG. 7, the back plates 72 are secured to the rear end face of each clamp housing 24 by means of four screws 114.

Figure 3:
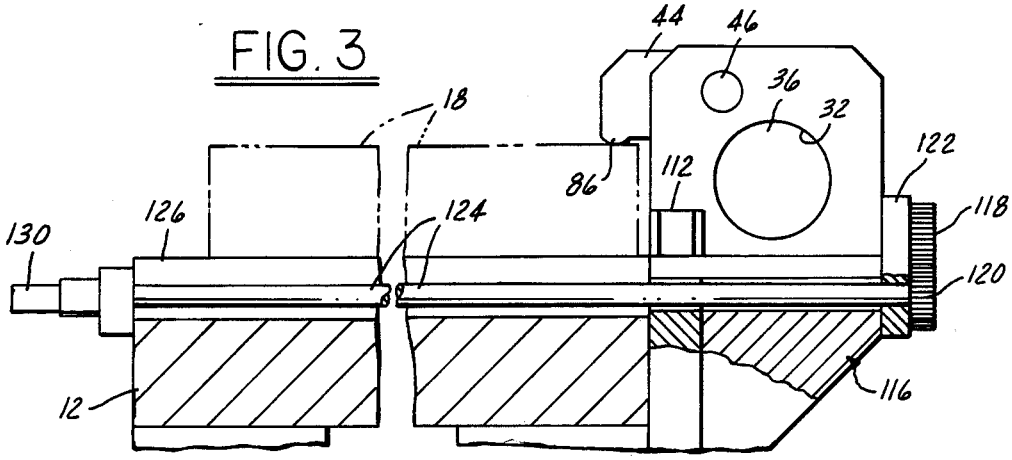
FIG. 3 is a fragmentary sectional view along the line 3—3 in FIG. 1l.
Figure 14:
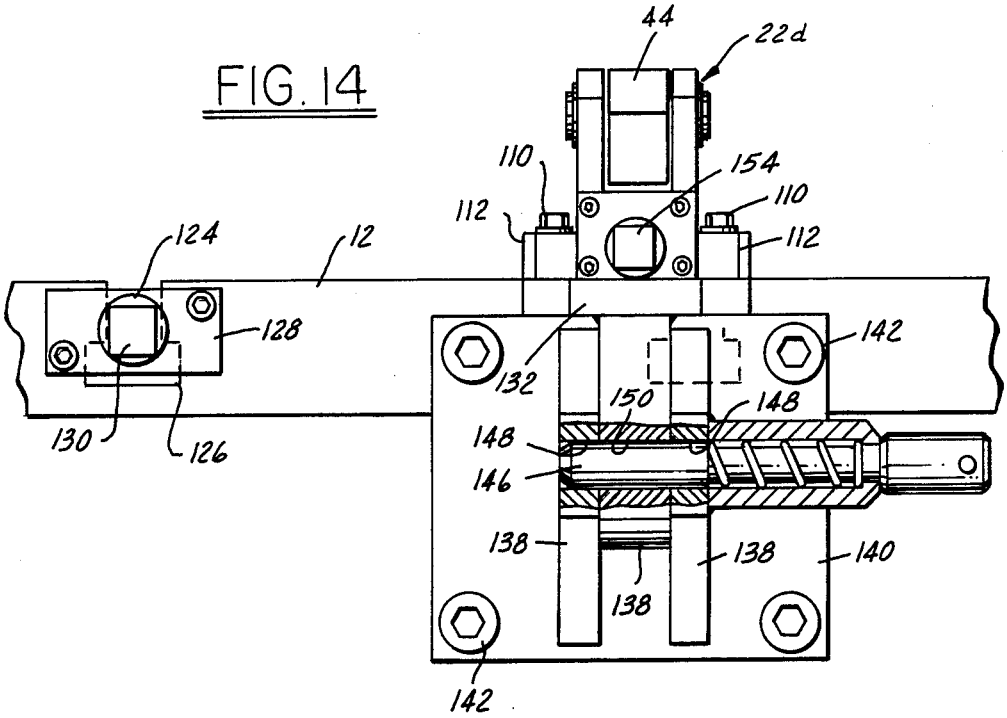
FIG. 14 is a view in the direction of the arrow 14 in FIG. 13.

Clamp *22c* shown in FIG. 1 at the rear side of the press is illustrated fixedly mounted at the rear edge of bolster 12 on a bracket 116. In the case of clamp *22c* the rotary nut is formed as or has mounted thereon a spur gear 118 which meshes with a similar spur gear 120 journalled on a back plate 122 below gear 118. Gear 120 is mounted at a shaft 124 extending horizontally to the front side of the press through a conventional T-slot 126 in the bolster 12 of the press. This is illustrated most clearly in FIGS. 1, 3 and 14. At the front side of the press shaft 124 is journalled in a support block 128 and is fashioned with a noncircular end 130 to facilitate manual rotation of the shaft.

Figure 4:
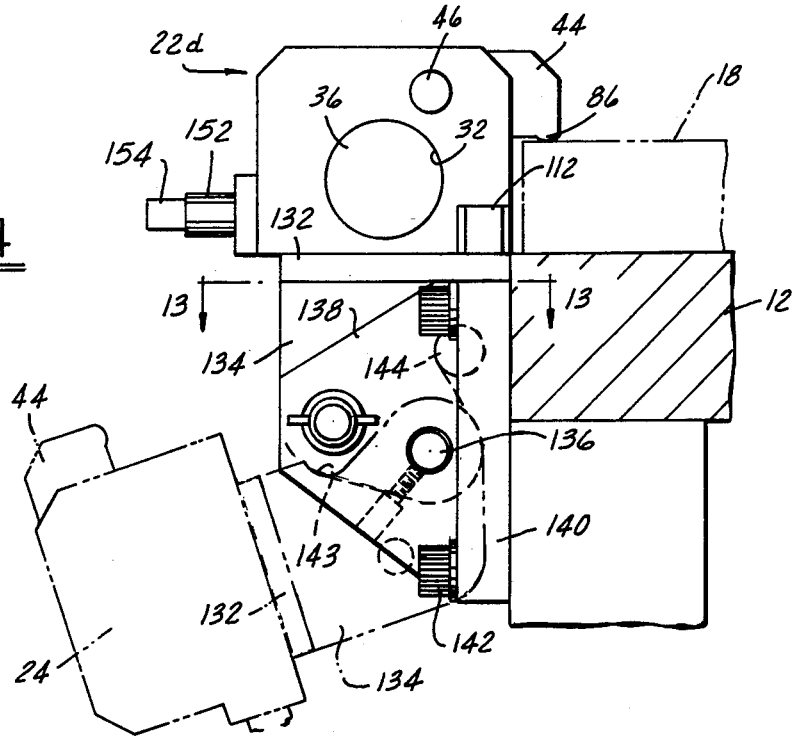
FIG. 4 is a sectional view along the line 4—4 in FIG. 1.

The clamp *22d* shown in FIG. 1 at the front side of the press is mounted on bolster 12 in a slightly different manner. In this case the clamp housing 24 is mounted as by screws 110 in ears 112 on a horizontal base plate 132 which is in turn welded to an upright plate 134. Plate 134 is in turn pivotally supported by a pin 136 (FIG. 4) between a pair of laterally spaced plates 138 welded to a vertical base plate 140 that is securely mounted on the front vertical face of bolster 12 by means of screws 142. As shown in FIG. 4, this arrangement enables clamp *22c* to be pivoted from the operative position shown in solid lines downwardly to the inoperative position shown in brokenlines. In the latter position the clamp is disposed entirely below the top face of the bolster 12 so as to avoid interference with the horizontal sliding movement of a die onto or off of the bolster from the front side of the press. In the operative position of clamp *22d* a notch 143 on the inner upright edge of plate 134 abuts against a pin 144 and a spring pressed shot pin 146 is adapted to be inserted through registering openings 148,150 in plates 138,134 so as to positively locate clamp *22d* firmly on the bolster in the operative position. In the case of clamp *22d* the rear end of nut 70 simply comprises a shaft 152 having a noncircular free end 154.

Thus it will be seen that by simply rotating a single shaft for each clamp both translatory and rocking movement will be imparted to the clamping lever. The die clamp is very compact in size and can be manufactured economically since it does not require expensive machining operations. Furthermore, the clamp of the present invention facilitates removal and replacement of dies in a press since the clamps can be operated from the front side of the press and since the clamping levers can be retracted to an out-of-the-way position that enables a die section to be raised and lowered vertically into and out of the press. Furthermore, by arranging the clamps at the front and/or the rear side of the press so that they can be pivoted downwardly to a position below the top face of the bolster, die sections can be shifted horizontally over the bolster without requiring actual removal of any of the clamps from the bolster. In addition it will be observed that, regardless of their position around the die, all of the clamps have the same basic construction and differ from one another only by the means on the rotatable nuts for actuating the clamp levers and by the design and the orientation of the back plate which retains the nut on the clamp housing.

I claim:

1. A die clamp comprising a housing adapted to be mounted ona press in a position adjacent the die member to be clamped, a clamping lever on said housing having one end adapted to be displaced downwardly into clamping relationw ith a portion of the die member, said lever being supported on said housing for translatory horizontal movement between a retracted position wherein said end of the lever is disposed laterally outwardly of and above said portions of the die member and an extended position wherein said end of the lever projects horizontally substantially beyond the adjacent side of the housing and over said portion of the die member, said lever also being supported on the housing for pivotal movement about a horizontal axis when in said extended position and rotatable actuating means on said housing operatively connected with said lever for imparting said two motions to said lever, said actuating means including a dog supported in said housing for rotation about an axis extending transversely of the direction of translatory motion of the lever, said dog being operatively connected with said lever to impart said translatory motion to the lever when the dog is rotated about is rotative axis and a cam rotatable in unison with said dog, said cam having a peripheral surface portion engageable with the lever to rotate the lever bout said horizontal axis to and from said clamping position.

2. A die clamp as called for in claim 1 wherein said actuating means also includes a rotatable threaded drive member on said housing and link means pivotally connected with said cam at one end and in threaded engagement with said threaded drive member at the other end such that when the drive member is rotated said link means are displaced longitudinallyb y reason of said threaded connection to thereby impart rotation to said dog and cam.

3. A die clamp as called for in claim 2 wherein said housing has a pair of axially aligned bores therein, the axis of which is generally parallel to said horizontal pivot axis of the lever, a pair of discs journalled one in each of said bore, means extending between and interconnecting said discs for rotation in unison, said interconnecting means including said cam.

4. A die clamp as called for in claim 3 including a pin extending transversely between said discs and offset from the axis thereof, said link means having one end pivotally connected to said pin, a threaded member in said housing connected to the other end of said pin, said drive member having a threaded connection with said threaded member and being axially fixed in said housing so that when the drive member is rotated in opposite directions it is adapted to rotate said discs through said linkage connection.

5. In a stamping press of the type having a bolster, an adapter plate supported o the top face of the bolster and a die fixedly mounted onthe adapter plate, means for clamping the adapter plate on the bolster comprising a support bracket fixedly mounted ona vertical face portion of the bolster plate, said support bracket terminating at its upper end at or below the upper face of tehb olster and a die clamp assembly supported on said support bracket, said die clamp assembly comprising a vertically extending plate pivotally mounted on said support bracket for pivotal movement about a horizontal axis, means for locking said vertical plate in fixed position on the support bracket when pivoted to an upright position, a clamp housing having a base fixedly mounted on the upper end of said vertical plate, a clamp lever pivotally mmounted in said housing, said clamp lever having one end thereof projecting over the adapter plate when the vertical plate is pivoted to said upright position and a manually rotatable drive member connected with said lever for pivoting said lever such that said end of the lever is displaced downwardly into clamping engagement with the adapter plate when the vertical plate is locked insaid upright position, said vertical plate and the clamp housing thereon when unlocked being pivotable downwardly on said mounting bracket from said upright position to an out-of-the-way position wherein both the vertical plate and the clamp housing are disposed entirely below the upper face of the bolster.

6. The combination called for in claim 15 including at least two additional clamps located on the bolster plate at diametrically opposite sides of the adapter plate and oriented perpendicularly to the first-mentioned clamp, each of said additional clamps having a housing, a clamp lever pivoted on the houisng about a horizontal axis and having one end shiftable downwardly into engagement with the adapter plate and a rotatable drive member for pivoting said clamp lever, the rotatable drive member of each of the last two-mentioned clamps having a bevel pinion gear fixed thereon adjacent the laterally outer end of the housings, a pair of shafts extending inwardly over the top face of the bolster from said vertical face portion thereof, each of said shafts having a bevel pinion gear fixed to the inner end thereof and meshing with the bevel pinion gears on each of the rotatable drive members on the additional clamps and means at the outer ends of said shafts and on the rotatable member of the first clamp to facilitate rotation thereof.

7. The combination called for in claim 6 wherein the first-mentioned clamp is located at the front side of the press.

8. The combination called for in claim 12 including a support bracket mounted on a vertical face portion of the bolster at the rear side of the press, a fourth clamp mounted on said last-mentioned support bracket, said fourth clamp having a housing, a clamping lever and a rotatable drive member substantially identical with the corresponding parts of the first-mentioned clamp, a spur gear fixed to the rotatable member of the fourth clamp, a shaft extending beneath said adapter plate between said two-mentioned vertical face portions of the bolster, the end of said shaft adjacent the rear of the press having a spur gear fixed thereon meshing with the spur gear on the rotatable member of the fourth clamp, said last-mentioned shaft extending forwardly beyond the front vertical face of the bolster and having means thereon to facilitate rotation of the shaft.

* * * * *

UNITED STATES PATENT OFFICE

CERTIFICATE OF CORRECTION

PATENT NO. : 4,665,733

DATED : May 19, 1987

INVENTOR(S) : Bernard J. Wallis

It is certified that error appears in the above-identified patent and that said Letters Patent are hereby corrected as shown below:

Column 1, line 12, "acdessible" should be --accessible--
Column 2, line 1, "mans" should --means--
Column 4, line 50, "brokenlines" should be --broken lines--
Column 5, line 19, "ona" should be --on a--
Column 5, line 22, "relationw ith" should be --relation with--
Column 5, line 26, "portions" should be --portion--
Column 5, line 40, "is" should be --its--
Column 5, line 43, "bout" should be --about--
Column 5, line 50, "longitudinallyb y" should be --longitudinally by--
Column 5, line 58, "bore" should be --bores--
Column 6, line 4, "o" should --on--
Column 6, line 5, "onthe" should be --on the--
Column 6, line 7, "ona" should be --on a--
Column 6, lines 8 and 9, "tehb olster" should be --the bolster--
Column 6, line 17, "mmounted" should be --mounted--
Column 6, line 31, "claim 15" should be --claim 5--
Column 6, line 36, "houisng" should be --housing--
Column 6, line 53, "claim 12" should be --claim 7--

Signed and Sealed this

Twenty-seventh Day of October, 1987

*Attest:*

DONALD J. QUIGG

*Attesting Officer*

*Commissioner of Patents and Trademarks*